United States Patent [19]

Pollet et al.

[11] 4,292,400

[45] Sep. 29, 1981

[54] PHOTOGRAPHIC SILVER HALIDE DEVELOPMENT IN THE PRESENCE OF THIOETHER DEVELOPMENT ACTIVATORS

[75] Inventors: Robert J. Pollet, Vremde; Francis J. Sels, Kontich; Karel A. Brems, Begijnendijk; Maurice A. de Ramaix, Hove, all of Belgium

[73] Assignee: Agfa-Gevaert, N.V., Mortsel, Belgium

[21] Appl. No.: 185,931

[22] Filed: Sep. 10, 1980

[30] Foreign Application Priority Data

Sep. 27, 1979 [GB] United Kingdom ..... 33608/79

[51] Int. Cl.[3] ..... G03C 5/30; G03C 1/48; G03C 7/00

[52] U.S. Cl. ..... 430/383; 430/434; 430/550; 430/469; 430/487; 430/564; 430/376; 430/407

[58] Field of Search ..... 430/487, 435, 377, 383, 430/545, 550, 564, 376, 469, 407, 434

[56] References Cited

U.S. PATENT DOCUMENTS

| | | | |
|---|---|---|---|
| 3,021,215 | 2/1962 | Williams et al. | 430/550 |
| 3,046,134 | 7/1962 | Dann et al. | 430/603 |
| 4,013,471 | 3/1977 | Pollet et al. | 430/487 X |
| 4,038,075 | 7/1977 | Pollet et al. | 430/487 X |
| 4,072,523 | 2/1978 | Pollet et al. | 430/487 X |
| 4,072,526 | 2/1978 | Sels et al. | 430/487 X |

*Primary Examiner*—Richard L. Schilling
*Assistant Examiner*—John L. Goodrow
*Attorney, Agent, or Firm*—A. W. Breiner

[57] ABSTRACT

Photographic elements containing image-wise developable silver halide are developed in the presence of an oxathioether development activator according to the formula:

$$R^1—A—(OCH_2CH_2)_n—S—A'—(X—A''-)_m—Y—R^2$$

wherein:

$R^1$ is H, alkyl, hydroxyalkyl, or $R^2$—Y—(A″—X)-$_m$—A′—S—,

A, A′, and A″ is alkylene, with the proviso that A is a monovalent bond when $R^1$ is hydrogen or alkyl or hydroxyalkyl, X is —OCO—, —$SO_2$—, —CONH—, or Y, Y is ligand or complexing function of the type of —S— and —N(Q)— (Q=H or alkyl), $R^2$ is alkyl, which may be substituted by OH, or when Y is —N(Q)—, $R^2$ together with Q may represent the atoms needed to complete a nitrogen-containing saturated ring, n is at least 2, and m is 0 or 1.

The development activators can be used in black-and-white development or in color development. They can be incorporated in the photographic material or in the developing solution.

In reversal processing they can also accomplish the task of the second exposure or of the fogging agent to render the silver halide remaining after the first development developable.

12 Claims, No Drawings

PHOTOGRAPHIC SILVER HALIDE DEVELOPMENT IN THE PRESENCE OF THIOETHER DEVELOPMENT ACTIVATORS

The present invention relates to the use of novel thioether development activators in the development of image-wise exposed silver halide materials, and to silver halide materials and silver halide developers containing these development activators.

It is known to increase the sensitivity of photographic emulsions by addition of chemical sensitizers e.g. sulphur-containing compounds, reducing agents and salts of gold or other noble metals or combinations of these compounds. Such chemical sensitizers are believed to enter into reaction with the silver halide so as to form at the surface of the silver halide minute amounts of silver sulphide or of silver or of other noble metals, which increase the sensitivity of the silver halide emulsion. This kind of chemical sensitization, however, reaches a limit beyond which further addition of sensitizer or further digestion with the sensitizer merely increases the fog of the emulsion with constant or decreasing speed.

As is known in the art, further increasing of the speed of the photographic reproduction system can be effected by the presence during development of alkylene oxide polymers, e.g. polyoxyethylene compounds, thioether compounds and/or onium or polyonium compounds of the ammonium, phosphonium or sulphonium type. These compounds sensitize the emulsion by development acceleration and may be used either in the emulsion or the developer. For instance the U.S. Pat. No. 3,038,805 of John R. Dann, Peter P. Chiesa and William G. Lovett, issued June 12, 1962, teaches the use of non-polymeric open-chain polyoxathioethers in photographic emulsions to increase the sensitivity of these emulsions. These compounds can be applied even though the ordinary processes of chemical sensitization have been carried out.

The U.S. Pat. No. 3,506,443 of Robert F. Motter issued Apr. 14, 1970, discloses the use of a green-supersensitizing combination of an oxacarbocyanine dye with a benzimidazolocarbocyanine dye in multilayer multicolour silver halide materials that contain a thioether sensitizer or that are processed in the presence of thioether sensitizers.

In the U.S. Pat. No. 4,013,471 of Robert Joseph Pollet, Camille Angelina Vandeputte, Francis Jeanne Sels, Gerard Laurens Vanreusel, Josef Frans Willems and George Frans van Veelan, issued Mar. 22, 1977, polyoxyethylene compounds carrying thioether groups as side-substituents on the linear chain are described for accelerating or activating development of exposed silver halide materials.

In the U.S. Pat. No. 4,038,075 of Robert Joseph Pollet, Francis Jeanne Sels and Camille Angelina Vandeputte, issued July 26, 1977, a method is described for developing an imagewise exposed photographic silver halide material with a developing solution containing derivatives of polyethylene glycol having at one or both sides a terminal group containing a thioether linkage.

It is an object of the present invention to further increase the speed of conventionally sensitized light-sensitive materials, to shorten the development time, and to enhance the density by means of oxathioether development activators.

The object of the present invention has been attained by the development of an imagewise exposed photographic silver halide element in the presence of an oxathioether development activator wherein the oxathioether development activator corresponds to the following general formula:

$$R^1—A—(OCH_2CH_2)_n—S—A'—(X—A''—)_m—Y—R^2$$

wherein:

$R^1$ represents hydrogen, a $C_1$-$C_4$ alkyl group e.g. methyl, a $C_1$-$C_4$ alkyl group substituted by one or more hydroxy groups, or the group $R^2$—Y—(A'—X)$_m$—A'—S—, A, A', and A'' (same or different) each represent a $C_1$-$C_5$ alkylene group, e.g. ethylene, with the proviso that A is a chemical monovalent bond when $R^1$ is hydrogen or alkyl or substituted alkyl, X represents —OCO—, —$SO_2$—, —CONH—, or the group Y, Y represents a ligand or complexing function of the type of —S— and —N(Q)—, Q being hydrogen or alkyl, $R^2$ represents a $C_1$-$C_4$ alkyl group e.g. methyl or a $C_1$-$C_4$ alkyl group substituted by one or more hydroxy groups e.g. hydroxyethyl or dihydroxypropyl, or when Y is —N(Q)—, $R^2$ may represent together with Q the atoms necessary to complete a nitrogen-containing saturated ring, e.g. a morpholino ring or a piperidino ring, n is a positive whole number of at least 2, and m is 0 or 1.

Specific examples of polyoxyethylene derivatives corresponding to the above general formula are:

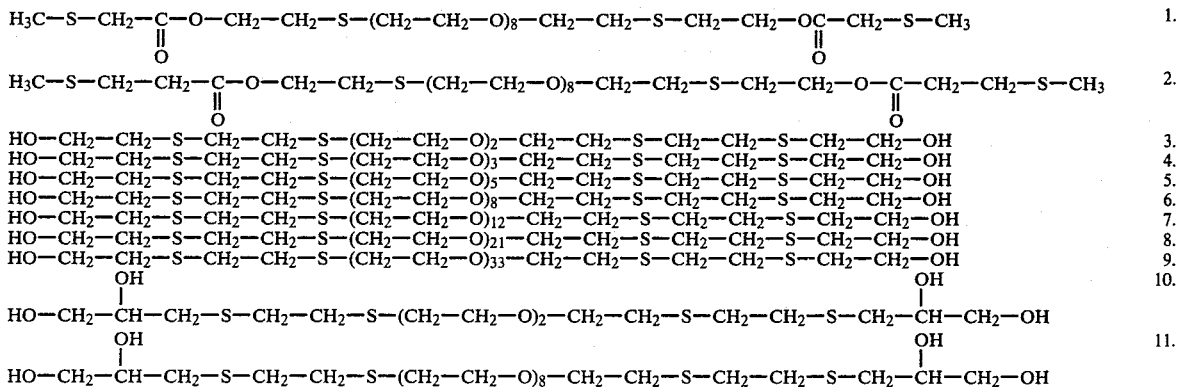

1. $H_3C—S—CH_2—C(=O)—O—CH_2—CH_2—S—(CH_2—CH_2—O)_8—CH_2—CH_2—S—CH_2—CH_2—OC(=O)—CH_2—S—CH_3$
2. $H_3C—S—CH_2—CH_2—C(=O)—O—CH_2—CH_2—S—(CH_2—CH_2—O)_8—CH_2—CH_2—S—CH_2—CH_2—O—C(=O)—CH_2—CH_2—S—CH_3$
3. $HO—CH_2—CH_2—S—CH_2—CH_2—S—(CH_2—CH_2—O)_2—CH_2—CH_2—S—CH_2—CH_2—S—CH_2—CH_2—OH$
4. $HO—CH_2—CH_2—S—CH_2—CH_2—S—(CH_2—CH_2—O)_3—CH_2—CH_2—S—CH_2—CH_2—S—CH_2—CH_2—OH$
5. $HO—CH_2—CH_2—S—CH_2—CH_2—S—(CH_2—CH_2—O)_5—CH_2—CH_2—S—CH_2—CH_2—S—CH_2—CH_2—OH$
6. $HO—CH_2—CH_2—S—CH_2—CH_2—S—(CH_2—CH_2—O)_8—CH_2—CH_2—S—CH_2—CH_2—S—CH_2—CH_2—OH$
7. $HO—CH_2—CH_2—S—CH_2—CH_2—S—(CH_2—CH_2—O)_{12}—CH_2—CH_2—S—CH_2—CH_2—S—CH_2—CH_2—OH$
8. $HO—CH_2—CH_2—S—CH_2—CH_2—S—(CH_2—CH_2—O)_{21}—CH_2—CH_2—S—CH_2—CH_2—S—CH_2—CH_2—OH$
9. $HO—CH_2—CH_2—S—CH_2—CH_2—S—(CH_2—CH_2—O)_{33}—CH_2—CH_2—S—CH_2—CH_2—S—CH_2—CH_2—OH$
10. $HO—CH_2—CH(OH)—CH_2—S—CH_2—CH_2—S—(CH_2—CH_2—O)_2—CH_2—CH_2—S—CH_2—CH_2—S—CH_2—CH(OH)—CH_2—OH$
11. $HO—CH_2—CH(OH)—CH_2—S—CH_2—CH_2—S—(CH_2—CH_2—O)_8—CH_2—CH_2—S—CH_2—CH_2—S—CH_2—CH(OH)—CH_2—OH$

-continued

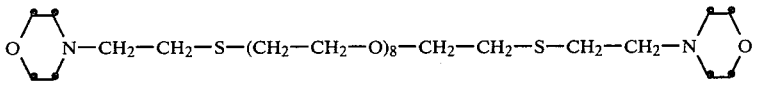

12.

$HO-CH_2CH_2S-CH_2CH_2S-CH_2CH_2S-(CH_2CH_2O)_8-CH_2CH_2S-CH_2CH_2SCH_2CH_2SCH_2CH_2OH$ 13.

$HO-CH_2CH_2S-CH_2CH_2S-(CH_2CH_2O)_7-CH_3$ 14.

The above compounds can be prepared as illustrated by means of the specific preparations hereinafter.

Preparation 1: compound 1

A solution of 52 g (0.1 mole) of $HOCH_2CH_2S(CH_2CH_2O)_8CH_2CH_2SCH_2CH_2OH$ (prepared as described in preparation 11 of the U.S. Pat. No. 4,038,075, already mentioned hereinbefore) in 600 ml of acetone (analytical grade) and 20.2 g (0.2 mole) of triethylamine was brought in a 1 l flask equipped with a stirrer, a thermometer, and a dropping funnel. An amount of 24.9 g. (0.2 mole) of methylthioacetyl chloride dissolved in 150 ml of acetone was added dropwise at 20°–25° C. The mixture was stirred for 3 hours at room temperature and allowed to stand for 60 hours. The mixture was then stirred again for 1 day at room temperature. The precipitate was filtered with suction, washed with acetone, and dried. The acetone solution was filtered through a fine cloth and concentrated by evaporation. Yield: 71 g.

Preparation 2: compound 2

52 g (0.1 mole) of $HOCH_2CH_2S(CH_2CH_2O)_8CH_2CH_2SCH_2CH_2OH$ dissolved in 700 ml of acetone (analytical grade) and 20.2 g (0.2 mole) of triethylamine were brought in a 1 l flask equipped with a stirrer, a thermometer and a dropping funnel. An amount of 27.7 g (0.2 mole) of $\beta$-methylthiopropionyl chloride dissolved in 200 ml of acetone (analytical grade) was added dropwise at 20°–25° C. The reaction was slightly exothermic. The reaction mixture was cooled with icewater, stirred for 6 hours at room temperature and allowed to stand for 60 hours. The mixture was then stirred again for 4 hours at room temperature. The precipitate was filtered with suction, washed with acetone, and dried. Subsequently, the solution was filtered through a fine cloth and concentrated by evaporation. Yield: 71 g.

Preparation 3: compound 3

9.2 g (0.4 mole) of sodium dissolved in 700 ml of ethanol and 31.2 g (0.4 mole) of 2-mercaptoethanol were brought in a 1 l flask fitted with a stirrer, a condenser, a thermometer and a dropping funnel. At room temperature 61.4 g (0.2 mole) of 1,14-dichloro-6,9-dioxa-3,12-dithiatetradecane were added.

The mixture was refluxed for 14 hours. Subsequently 2 ml of ethanol/hydrochloric acid were added to adjust the pH-value to 7. The mixture was allowed to stand overnight. A part of the final product had crystallized out. The precipitate was filtered by suction and washed with acetone. The final product dissolved, whereas sodium chloride remained. The ethanol and acetone filtrates were concentrated by evaporation. Yield: 76 g.

Preparations 4–9

The compounds 4 to 9 were prepared analogously to compound 3 starting from the corresponding polyoxadithiaalkanes.

Preparation 10: compound 10

9.2 g (0.4 mole) of sodium dissolved in 700 ml of ethanol and 43.2 g (0.4 mole) of thioglycerol were placed in a 1 l flask equipped with a stirrer, a condenser, a thermometer, and a dropping funnel. Subsequently, 61.4 g (0.2 mole) of 1,14-dichloro-6,9-dioxa-3,12-dithiatetradecane were added dropwise at room temperature. The mixture was then refluxed on an oil-bath for 7 hours. After standing overnight the final product appeared to have crystallized. The crystals were filtered by suction. After crystallization in acetone the yield was 43 g. Melting point: 70° C.

Preparation 11: compound 11

This compound was prepared analogously to compound 10.

Preparation 12: compound 12

106.5 g (0.15 mole) of the bis-toluene sulphonic acid ester of polyethylene glycol (molecular weight 400) dissolved in 800 ml of ethanol were placed in a 2 l flask fitted with a stirrer, a condenser, a thermometer, and a dropping funnel. 6.9 g (0.3 mole) of sodium dissolved in 400 ml of ethanol and 44.1 g (0.3 mole) of 2-mercaptoethylmorpholine were added. The reaction mixture was stirred for 2 hours at room temperature and allowed to stand for 60 hours. Subsequently, it was refluxed for 24 hours on an oilbath. The precipitate was filtered by suction, washed with ethanol, and dried. The alcohol filtrate was then concentrated by evaporation and the residue obtained was added to approximately 1 l of acetone. The precipitate was sucked off, washed with acetone, and dried. The acetone filtrate was concentrated by evaporation. The total yield of product according to the above structural formula was 97 g.

Preparation 13: compound 13

(a) 160 g (0.25 mole) of compound 6 dissolved in 1200 ml of methylene chloride were brought in a 2 l flask equipped with a stirrer, a thermometer, and a dropping funnel. An amount of 61.8 g (0.52 mole) of thionyl chloride was added dropwise thereto with stirring at room temperature. The resulting mixture was stirred for 4 hours at room temperature. Next, it was left standing for 60 hours. Nitrogen was then bubbled through the mixture for some 12 hours until hydrogen chloride escaped nomore. After filtration and concentration by evaporation 160 g of dichloride were obtained.

(b) In a 700 ml flask equipped with a stirrer, a condenser, a thermometer, and a dropping funnel 4.6 g of sodium dissolved in 300 ml of ethanol were placed. At room temperature 15.6 g (0.2 mole) of mercaptoethanol were added with stirring. Next, a solution of 67.7 g (0.1 mole) of the compound obtained in step (a) dissolved in 250 ml of acetone was added dropwise at room temperature. The mixture was stirred for 2 hours at room temperature and then left standing overnight. Next, the mixture was refluxed for 8 hours and left standing again overnight. More ethanol was added and the temperature was increased to 55° C. Sodium chloride was filtered off with suction while still in hot condition, rinsed with hot ethanol, and dried (11.2 g). The partially crystallized filtrate was concentrated by evaporation. Yield: 74 g.

Preparation 14: compound 14

(a)

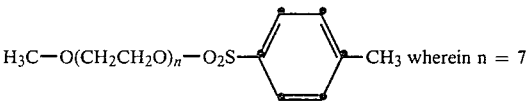

210 g (0.6 mole) of methoxy-polyethylene glycol (molecular weight 350) in 450 ml of anhydrous benzene and 114 g (0.6 mole) of p-toluene sulphochloride in 450 ml of anhydrous benzene were brought successively in a flask. An amount of 60.6 g (0.6 mole) of triethylamine in 150 ml of anhydrous benzene were added dropwise at room temperature to the resulting clear solution. The mixture was left standing for several days. After filtration the benzene filtrate was concentrated by evaporation. 297.5 g of oil were obtained.

(b)
$H_3C—O(CH_2CH_2O)_{n-1}CH_2CH_2S—CH_2CH_2OH$ 23 g (1 mole) of sodium dissolved in 1500 ml of ethanol were placed in a 3 l flask equipped with a stirrer, a condenser, a thermometer, and a dropping funnel. 78 g (1 mole) of mercaptoethanol were added with stirring at room temperature. Next 504 g (1 mole) of compound (a) were added dropwise at room temperature. The mixture was stirred for 2 hours at room temperature and left standing overnight. The mixture was then refluxed for 8 hours. The precipitate was filtered with suction, washed with ethanol, and dried. The ethanol filtrate was concentrated by evaporation and the residue was added to acetone. The precipitate was filtered again with suction and the acetone filtrate was concentrated by evaporation. Yield: 372 g.

(c)
$H_3C—O(CH_2CH_2O)_{n-1}CH_2CH_2S—CH_2CH_2Cl$ 205 g (0.5 mole) of compound (b) dissolved in 700 ml of methylene chloride were placed in a 1 l flask equipped with a stirrer, an air cooler, a thermometer, and a dropping funnel. At room temperature 62.5 g of (0.525 mole) of thionyl chloride were added with stirring. After the addition the stirring was continued for 2 hours at room temperature. The mixture was stirred overnight. Next, nitrogen gas was bubbled through until hydrogen chloride evolved nomore. After filtration through a fine cloth and concentration by evaporation 210 g of (c) were obtained.

(d)
$H_3C—O(CH_2CH_2O)_{n-1}CH_2CH_2S—CH_2CH_2S—CH_2CH_2OH$ 5.75 g (0.25 mole) of sodium were dissolved in 500 ml of ethanol and placed in a 1 l flask equipped with a stirrer, a condenser, and a dropping funnel. 19.5 g (0.25 mole) of mercaptoethanol were added at room temperature. Next, 107.1 g (0.25 mole) of compound (c) were added dropwise at room temperature. The mixture was refluxed for 7 hours with stirring. After filtration and concentration by evaporation 118 g of residue were obtained.

The development activators for use in a silver halide development according to the invention can be employed for various kinds of photographic silver halide materials. They can be used in the black-and-white development as well as in the colour development of photographic silver halide materials. They can be incorporated in the photographic material, in particular in the silver halide emulsion layers, or in the developing solution.

The development activators of the present invention are incorporated into the developer composition comprising black-and-white developing agents e.g. hydroquinone, hydroquinone/1-phenyl-3-pyrazolidinone, hydroquinone/p-monomethylaminophenyl sulphate or colour developing agents more particularly aromatic primary amino colour developing agents e.g. p-phenylene diamine colour developing agents. The compounds are particularly suitable for use in the colour developing compositions for reversal processing.

The development accelerating compounds can be utilized in various concentrations, depending upon the effects desired, the particular silver halide emulsions employed, the thickness of the emulsion layers, the concentration of silver halides in the emulsions, the concentration of developing agents in the developers, the pH of the developers etc. The optimum amount for any given compound can be determined for any particular developer or material by running a series of tests in which the quantity is varied over a certain range.

In general, useful results are obtained when the concentration of the development activator according to the invention in the developer is from 50 mg to 10 g per liter and in the emulsion is from 10 mg to 500 mg per mole of silver halide. The activity will obviously depend upon various factors, e.g. the temperature of development, which may be room temperature or elevated temperature e.g. above 30° C., and the development time.

Silver halide emulsions that are developed in the presence of the compounds corresponding to the above general formula may comprise as light-sensitive silver halide, silver bromide, silver iodide, silver chloride or mixed silver halides e.g. silver chlorobromide, silver chlorobromoiodide or silver bromoiodide. The emulsions can be chemically sensitized by any of the accepted procedures. The emulsions can be digested with naturally active gelatin or with sulphur-containing compounds e.g. allyl isothiocyanate, allyl thiourea or sodium thiosulphate. The emulsion can also be digested in the presence of reducing agents e.g. the tin compounds described in Belgian Pat. Nos. 493,464 filed Jan. 24, 1950 and 568,687 filed June 18, 1958, both by Gevaert Photo-Producten N.V., the iminoaminomethane sulphinic acid compounds described in United Kingdom Patent Specification No. 789,823 filed Apr. 29, 1955 by Gevaert Photo-Producten N.V., polyamines e.g. diethylene triamine, spermine, and bis(β-aminoethyl) sulphide. They can further be digested in the presence of noble metal compounds such as ruthenium, rhodium, palladium, iridium, platinum, and gold compounds as described by R. Koslowsky, Z.Wiss.Phot. 46, 65–72 (1951). Representative compounds are ammonium chloropalladate, potassium chloroplatinate, sodium chloropalladite, potassium chloroaurite, potassium aurithiocyanate, potassium chloroaurate, gold(III) chloride, gold(I) sulphide, etc.

The emulsions can comprise emulsion-stabilizers and fog-inhibiting compounds e.g. the mercury compounds such as those described in Belgian Pat. Nos. 524,121 filed Nov. 7 , 1953 by Kodak Ltd., and 677,337 filed Mar. 4, 1966 by Gevaert Photo-Producten N.V., and in published Dutch Patent Application No. 67/15932 filed Nov. 23, 1967 by Gevaert-Agfa N.V., organic sulphur-containing compounds that form insoluble silver salts with silver ions, heterocyclic nitrogen-containing thioxo compounds or derivatives thereof, e.g. benzothiazoline-2-thione, 1-phenyl-2-tetrazoline-5-thione and 2-ethoxycarbonylthio-5-aminothiadiazole, the compounds described in Belgian Pat. Nos. 571,916 and 571,917, both filed Oct. 10, 1958 by Gevaert Photo-Producten N.V., thiazolinium compounds of the type described in Product Licensing Index, December 1971 issue, p. 90–91, benzothiazolium p-toluene 2,3-dimethyl-5-methoxycarbonyl benzothiazolium-p-toluene sulphonate and tetra- or pentaazaindenes especially those substituted by hydroxyl or amino groups e.g. those described by Birr, Z.Wiss.Phot. 47, 2–58 (1952). A very effective azaindene emulsion stabilizer is 5-methyl-7-hydroxy-s-triazolo[1,5-a]pyrimidine, which can be use together with other emulsion stabilizers e.g. those of the type described above.

The emulsions may be X-ray and other non-spectrally sensitized emulsions as well as orthochromatic, panchromatic, or infrared-sensitive emulsions. The emulsions may be spectrally sensitized by means of neutrocyanines, carboxycyanines, rhodacyanines, hemicyanines, merocyanines, oxonol dyes, styryl dyes and the like as described by F. M. Hamer in "The cyanine dyes and related compounds" (1954).

The emulsions may further comprise other compounds that sensitize the emulsion by development activation e.g. alkylene oxide polymers. These alkylene oxide polymers may be of various type e.g. polyethylene glycol having a molecular weight of 1500 or more, alkylene oxide condensation products or polymers as described in U.S. Pat. Nos. 1,970,578 of Conrad Schoeller and Max Wittwer, issued Aug. 21, 1934, 2,240,472 of Donald R. Swan, issued Apr. 29, 1941, 2,423,549 of Ralph Kingsley Blake, William Alexander Stanton and Ferdinand Schulze, issued July 8, 1947, 2,441,389 of Ralph Kingsley Blake, issued May 11, 1948, 2,531,832 of William Alexander Stanton, issued Nov. 28, 1950 and 2,533,990 of Ralph Kingsley Blake, issued Dec. 12, 1950 and in U.K. Pat. Specifications Nos. 920,637 filed May 7, 1959, 940,051 filed Nov. 1, 1961, 945,340 filed Oct. 23, 1961, all by Gevaert Photo-Producten N.V., 991,608 filed June 14, 1961 by Kodak Ltd., and 1,015,023 filed Dec. 24, 1962 by Gevaert Photo-Producten N.V. These development activating compounds may also be present in the silver halide developing solution. Other development activating compounds are onium and polyonium compounds preferably of the ammonium, phosphonium, and sulphonium type.

Other addenda e.g. hardening agents, wetting agents, plasticizers, matting agents, e.g. polymethyl methacrylate and silica particles, and light-screening dyes may be present in the silver halide emulsion or in another layer of the light-sensitive materials used according to the invention.

The development accelerators applied according to the present invention can be utilized in developers for various kinds of photographic silver halide materials e.g. black-and-white emulsions, which include X-ray and lith emulsions and colour emulsions. They can be used in the silver complex diffusion transfer process and in addition to being useful for negative processing they can also be used for reversal processing. In reversal processing, in which after a first black-and-white development residual silver halide is rendered developable by uniform reexposure or by a chemical treatment and then developed by a second development, which may be black-and-white or colour, the development activators for use according to the invention are preferably contained in the second developer so that development of the residual silver halide rendered developable is activated and thus maximum density is increased.

The compounds for use according to the present invention have found to be particularly useful for the development, especially reversal development, of photographic colour emulsions.

The compounds used according to the present invention have a high development activating effect so that they can be incorporated in the second (reversal) developer of a reversal development process for formation of positive images and so that it is possible, dependent on the energy of the developer used, the development temperature, the concentration of the compound involved and the type of silver halide material to develop positive image of sufficient density, even in the absence of an overall re-exposure step after the first development or in the absence of fogging agents for rendering developable the unexposed but image-wise distributed silver halide remaining after the first development. Of course, such re-exposure step or such fogging agents can be included. Particularly suitable fogging agents are the tin(II) complexes of aminocarboxylic acids as described in U.S. Pat. No. 3,658,535 of Jozef Frans Willems, issued Apr. 25, 1972, and of organophosphonic acids as described in U.S. Pat. No. 3,617,282 of Charleton C. Bard, Arthur D. Kuh and Richard J. Malloy, issued Nov. 2, 1971.

The thioether compounds can be used in the production of multicolour images as well as in the production of monochromic images e.g. monochromic radiographic dye images according to the technique described in U.S. Pat. No. 3,734,735 of Jacques Elie Bories, issued May 22, 1978 and published German Patent Application No. 2,165,193 filed Dec. 29, 1971 by Agfa-Gevaert A. G. They can also be used in colour diffusion transfer processes.

As is known in the art of silver halide colour photography, dyestuff images are formed by coupling of appropriate colour forming couplers with the oxidation products of aromatic primary amino colour developers particularly p-phenylene diamine colour developing agents. By the presence of the development activators during development the maximum density of the dyestuff images as well as the contrast can be increased, which results in improved colour saturation. Moreover, in addition to having a favourable development activating action, these compounds do not give rise to difficulties in the subsequent bleaching of the silver image as often occurs when development activating onium compounds e.g. quaternary ammonium compounds are used.

In multilayer photographic materials used in colour photography for the reproduction of multicolour images there are generally three selectively sensitive emulsion layers (each of which may consist of several strata finished to different speed levels) coated at the same side of a photographic support e.g. a film or paper support. Such multilayer materials may also have other layers for special purposes including gelatin or other subbing layers, antihalation layers, and protective coatings.

The three selectively sensitive emulsion layers are a blue-sensitive emulsion layer, an emulsion layer sensitized to the green region of the spectrum, and an emulsion layer sensitized to the red region of the spectrum. Inasmuch as many photographic silver halide emulsions have an inherent blue sensitivity, the photographic materials usually have a yellow filter layer beneath the blue-sensitive uppermost emulsion layer for the purpose of absorbing substantially all blue radiation that would otherwise be transmitted to the green- and red-sensitized emulsion layers.

Though the invention is primarily concerned with development activation of colour materials comprising the colour-forming couplers in the silver halide emulsions, the materials may also be of the type well known in the art and designed for processing in developers containing the colour-forming couplers in the colour developer.

The colour-forming couplers are of the customary types employed in colour photography: pyrazolone couplers for formation of the magenta image, phenolic or naphtholic couplers for formation of the cyan image, and open-chain compounds containing a reactive methylene group for formation of the yellow image.

When the multicolour elements have incorporated colour couplers the blue-sensitive emulsion layer contains the yellow-forming colour coupler, the green-sensitized emulsion layer contains the magenta-forming colour coupler, and the red-sensitized emulsion layer contains the cyan-forming colour coupler.

For the incorporation of the colour-forming couplers into the silver halide emulsions, the conventional methods can be applied. For instance the couplers can be incorporated from solutions in high-boiling sparingly water-miscible solvents such as di-n-butyl phthalate and tricresyl phosphate or in low-boiling sparingly water-miscible solvents such as ethyl acetate, methylene chloride and chloroform, or mixtures of both types of solvents. For this purpose these solutions are dispersed in extremely fine droplets, preferably in the presence of a wetting or dispersing agent into the hydrophilic colloid medium, the low-boiling sparingly water-miscible solvent then being removed by evaporation. Of course, other techniques known by those skilled in the art for incorporating colour couplers, into colloid compositions can be used. For instance, the water-soluble colour couplers i.e. those containing a water-solubilizing sulpho group, in acid or salt form, can be incorporated into the coating composition of the layer in question from an aqueous or alkaline solution.

Typical colour couplers, which are useful in colour photography and can be used in accordance with the present invention are those listed in the U.S. Pat. No. 3,038,805, already mentioned hereinbefore.

Other interesting colour couplers are the following:

cyan-forming colour couplers

N-[4'-(2''-cyclopentyl-4''-tert.-butyl-phenoxy)-butyl]-1-hydroxy-2-naphthamide sodium salt of N-(2'-methyl-N-octadecylamino-5'-sulpho)-1-hydroxy-4-{2''-methoxycarbonyl-4''[1'''-(4''''-hydroxyphenyl)-isopropyl]-phenylazo}2-naphthanilide yellow-forming colour coupler benzoylacetyl-2',5'-dimethoxy-4'-N-methyl-N-n-hexadecylaminosulphonylanilide magenta-forming colour couplers 1-(2',4',6'-trichloro)-phenyl-3-{3'-[1''-(2''',4'''-ditert-pentyl-phenoxy)-propyl]-carbonylamino-benzamido}-Δ2-pyrazolin-5-one 1-(2',4',6'-trichloro)-phenyl-3-(2''-chloro-5''-n-hexadecyloxycarbonylanilino)-Δ2-pyrazolin-5-one 1-o-(2'-chloro-1',1',2'-trifluoro)-ethoxyphenyl-3-p-n-hexadecylsulphonylanilino-4-p-(2''-phenoxyethoxy)-phenylazo-Δ2-pyrazolin-5-one 1-(2',4',6'-trichloro)-phenyl-3-[3''-(2''',4'''-di-tertpentyl-phenoxy)-acetylamino]-benzamido-4-p-methoxy-phenylazo-Δ2-pyrazolin-5-one.

It is of course possible to use combinations of colour couplers e.g. combinations of the colour couplers specified above as well as combinations of colour couplers with development-inhibitor-releasing compounds and/or with antistain agents, i.e. oxidized developing agent scavengers such as those referred to in Research Disclosure no. 17643 of December 1978, page 25, paragraph I, more particularly antistain agents of the class of mono- or di-alkyl-hydroquinones e.g. 2,5-di-n-octyl and 2,5-diisooctyl-hydroquinones.

The hydrophilic colloid composition, into which the colour couplers are initially dispersed or dissolved, need not necessarily contain the light-sensitive silver halide. The colour coupler compounds may advantageously be dispersed or dissolved first in an aqueous non-lightsensitive hydrophilic colloid solution whereupon the resultant mixture, possibly after the removal of the organic solvents employed, is intimately mixed with the light-sensitive silver halide emulsion just before coating.

For more details about particularly suitable techniques that may be employed for incorporating colour couplers into a silver halide emulsion layer of a photographic material there can be referred to e.g. U.S. Pat. Nos. 2,269,158 to Michele Martinez, issued Jan. 6, 1942, 2,284,887 of Emil Vollenweider, issued June 2, 1942, 2,304,939 and 2,304,940, both of Leopold D. Mannes and Leopold Godowsky Jr., issued Dec. 15, 1942, and 2,322,027 of Edwin E. Jelley and Paul W. Vittum, issued June 15, 1943, United Kingdom Pat. Specifications Nos. 791,219 filed Nov. 9, 1945 by Kodak Ltd., 1,098,594, 1,099,414, 1,099,415, 1,099,416 and 1,099,417, all filed Jan. 25, 1965 by Gevaert-Agfa N.V., French Pat. Specification No. 1,555,663, filed Oct. 20, 1967 by Gevaert-Agfa N.V., Belgian Pat. No. 722,026, filed Oct. 9, 1968 by Gevaert-Agfa N.V., German Pat. No. 1,127,714 filed Aug. 20, 1960 by Perutz Fotowerke G.m.b.H., and U.K. Pat. No. 1,297,947 filed Mar. 20, 1969 by Agfa-Gevaert N.V.

Another technique for incorporating colour couplers is via polymeric latices as described in the published German Patent Applications DE-OS Nos. 2,541,230 and 2,541,274 both filed Sept. 16, 1975 by Kodak Co.

In colour development aromatic primary amino developing substances may be used, which are capable of forming azomethine dyes by coupling in their oxidized form with the colour-forming couplers. Suitable developing agents are more particularly p-phenylene diamine and derivatives thereof e.g. N,N-dialkyl-p-phenylene diamines, N,N-dialkyl-N'-sulphomethyl-p-phenylenediamine, N,N-dialkyl-N'-carboxymethyl-p-phenylenediamine, the sulphonamido-substituted p-phenylene diamines disclosed in U.S. Pat. No. 2,548,574 of Arnold Weissberger, Dudley B. Glass and Paul W. Vittum, issued Apr. 10, 1951, and other substituted p-phenylene diamines disclosed in U.S. Pat. No. 2,566,271 of Arnold Weissberger and Dudley B. Glass, issued Aug. 28, 1951.

Typical examples of p-phenylenediamines are N,N-diethyl p-phenylene diamine, 2-amino-5-diethylaminotoluene, N-butyl-N-sulphobutyl-p-phenylene diamine, 2-amino-5-[N-ethyl-N(β-methylsulphonamido)ethyl]aminotoluene, N-ethyl-N-β-hydroxyethyl-p-phenylenediamine, etc. In general, these developing agents are used in salt form e.g. the hydrochloride or sulphate.

The multicolour elements can be motion picture materials which may be provided with optical or magnetic sound recording stripes. Such multicolour elements have transparent film support e.g. cellulose acetate or polyethylene terephthalate supports carrying on one side the light-sensitive colour forming silver halide emulsion layers and at the other side an antihalation coating, e.g. containing carbon black, which is capable of being detached from the support during processing in an alkaline solution. Magnetic recording stripes can be applied to the antihalation coating without being detached from the support together with the antihalation layer, by using an alkali-insoluble binder for the sound stripe and incorporating a cross-linking agent therein for the alkalisoluble binder of said antihalation layer. This has been described in German Pat. No. 2,320,657 filed Apr. 24, 1973 by Fuji Photo Film, German Pat. No. 2,126,415 filed May 27, 1971 by Fuji Photo Film, French Pat. No. 2,124,672 filed Dec. 27, 1971 by Agfa-Gevaert N.V., U.S. Pat. Nos. 3,891,444 issued June 24, 1975, 3,852,069 issued Dec. 3, 1974 and 3,840,374 issued Oct. 8, 1974, all of August Jean Van Paesschen and Joseph Antoine Herbots, etc. For the adhesion of the antihalation layer to the film support e.g. cellulose triacetate or polyethylene terephthalate support an insoluble primer layer can be used as described in U.K. Patent Specification No. 1,533,555 filed Nov. 7, 1975 by Agfa-Gevaert N.V. It is also possible to use an alkali-soluble primer layer comprising a binder of the type described for the alkali-soluble antihalation layers e.g. copoly(vinyl acetate-crotonic acid)(95/5), copoly(methylmethacrylate-ethylacrylate-methacrylic acid)(30/50/20), copoly(ethylacrylate-methacrylic acid) (80/20), copoly(styrene-maleic acid). Such alkali-soluble primer layer is removed during processing together with the antihalation layer. In order to prevent that the magnetic sound stripe is also removed during processing, the alkali-soluble binders of both the primer and the antihalation layers are insolubilized underneath the magnetic recording stripe by diffusion of bis- or polyfunctional compounds from the sound recording stripe to the antihalation layer and primer layer. These compounds are capable of entering into reaction with the free acid groups of the binders of the antihalation layer and the primer layer, thus accomplishing cross-linking thereof. Examples of suitable bis- or polyfunctional compounds have been described in the patents and patent applications referred to hereinbefore and include compounds with at least two aziridine groups, epoxide groups, aldehyde groups, acryloyl or methacroyl groups, groups containing reactive halogen atoms e.g. sulphofluoride groups, isocyanate groups, carbodiimide groups.

The following examples illustrate the present invention.

EXAMPLE 1

Strips of commercially available multicolour reversal film materials marketed by Agfa-Gevaert N.V., Mortsel, Belgium under the trade-marks Gevachrome S Type 700 and Gevachrome Type 710, said materials containing incorporated colour couplers for the cyan, magenta, and yellow separation images, were exposed through a grey continuous wedge to white light in a Herrnfeld Sensitometer.

The exposed strips were then processed as follows:

treatment for 10 s at 25° C. in a pre-bath of the following composition:

| | |
|---|---|
| water | 600 ml |
| tetrasodium salt of ethylene diamine tetraacetic acid | 2 g |
| anhydrous sodium sulphate | 100 g |
| borax (10 $H_2O$) | 15 g |
| sodium hydroxide | 0.8 g |
| water to make | 1000 ml |
| | (pH 9.30) |

rinsing for 15 s and brushing of the backing to remove the antihalation layer;

developing for 3 min 20 s at 25° C. in a black-and-white developer of the following composition:

| | |
|---|---|
| water | 600 ml |
| hydroquinone | 6 g |
| 1-phenyl-4-methyl-pyrazolidin-3-one | 0.5 g |
| sodium hexametaphosphate | 2 g |
| anhydrous sodium sulphite | 50 g |
| anhydrous sodium carbonate | 25 g |
| potassium bromide | 2.3 g |
| potassium thiocyanate | 3 g |
| potassium iodide | 6 mg |
| aqueous solution of polyethylene glycol 1000 | 5 ml |
| water to make | 1000 ml |
| | (pH 10.2) |

treatment for 45 s at 25° C. in a stopbath of the following composition:

| | |
|---|---|
| water | 700 ml |
| potassium alum | 15 g |
| borax (10 $H_2O$) | 21 g |
| glacial acetic acid | 10 ml |
| water to make | 1000 ml |
| | (pH 4.2) |

Alternatively the borax can be replaced by a hydroxycarboxylic acid acting as complexing agent in the aluminum-containing hardening stopbath, for instance citric acid ana tartaric acid can be employed as complexing agent. They are used in such an amount that the ph remains between 4 and 4.5.

rinsing with water for 45 s at 23° C. while overall re-exposing the material;

colour developing for 4 min 15 s at 25° C. in a colour developer of the following composition:

| | |
|---|---|
| water | 500 ml |
| sodium hexametaphosphate | 2 g |
| anhydrous sodium sulphite | 4 g |
| potassium bromide | 0.75 g |
| anhydrous sodium carbonate | 25 g |
| sodium hydrogen carbonate | 0.3 g |
| potassium iodide | 4 mg |
| N,N-diethyl-p-phenylene diamine | |

-continued

| | |
|---|---|
| hydrochloride | 2.7 g |
| development activator as listed in the table hereinafter | 2 g |
| water to make | 1000 ml (pH 10.7) |

stop fixing for 30 s at 25° C. in the following fixing solution:

| | |
|---|---|
| water | 700 ml |
| anhydrous sodium sulphite | 10 g |
| sodium metabisulphite | 8.75 g |
| boric acid | 6.25 g |
| sodium acetate (3 $H_2O$) | 6 g |
| glacial acetic acid | 10 ml |
| aluminium chloride (6 $H_2O$) | 10 g |
| ammonium thiosulphate | 175 g |
| water to make | 1000 ml (pH 4.3) |

rinsing with water for 1 min at 23° C.;

silver bleaching for 2 min at 25° C. in the following bleach bath:

| | |
|---|---|
| water | 600 ml |
| potassium hexa-cyanoferrate(III) | 40 g |
| potassium bromide | 30 g |
| sodium acetate (3 $H_2O$) | 5 g |
| glacial acetic acid | 5 ml |
| sodium hydrogen sulphate | 6 g |
| tetra-sodium salt of ethylenediamine tetraacetic acid | 10 g |
| water to make | 1000 ml (pH 4.1) |

rinsing with water for 1 min at 23° C.;

treating for 1 min at 25° C. in the above fixing solution;

rinsing with water for 1 min 30 s at 23° C., and stabilizing for 10 s at 25° C. in a stabilizing bath comprising per liter 12.5 ml of a 40% aqueous solution of formaldehyde and 1.8 ml of a wetting agent such as saponine, and drying for 3 to 5 min at 40° to 50° C. in air having a relative humidity of 20–50%.

In the Tables I A and I B hereinafter a comparison is made between the sensitometric results obtained on the one side with known polyoxyethylene derivatives carrying on both sides of the oxyethylene chain one thioether linkage viz. the compound described in Example 1 of U.S. Pat. No. 3,038,805, already mentioned hereinbefore, and thioether compounds of the type described in U.S. Pat. No. 4,038,075, already mentioned hereinbefore, and on the other side with polyoxyethylene derivatives according to the present invention, which on both sides of the oxyethylene chain carry two ligand or complexing functions.

Care is taken to compare each time a known dithioether with a compound according to the invention, both having a same number of oxyethylene groups.

Values of fog, speed, gamma, and maximum density are given.

The values given for the speed are relative values corresponding to density 1.0. The speed obtained with the material developed in the presence of the compound described in Example 1 of the U.S. Pat. No. 3,038,805, already mentioned hereinbefore, is given the value 100 (control). The other speed values are percent values in respect of the control.

The values given for gamma are the values of gradation measured from the characteristic curve over an exposure range of log It=0.60 starting from a density value of 0.7 above fog.

| | fog | | | speed | | | gamma | | | $D_{max}$ | | |
|---|---|---|---|---|---|---|---|---|---|---|---|---|
| | blue | green | red | blue | green | red | blue | green | red | blue | green | red |
| IA Gevachrome T700 | | | | | | | | | | | | |
| Compound described in example 1 of U.S. Pat. No. 3,038,805 | 0.18 | 0.22 | 0.24 | 100 | 100 | 100 | 1.20 | 1.39 | 1.47 | 2.70 | 3.15 | 3.23 |
| compound 3 of the present invention | 0.25 | 0.23 | 0.29 | 166 | 123 | 141 | 1.23 | 1.67 | 1.71 | 2.65 | 3.30 | 3.46 |
| compound A | 0.14 | 0.19 | 0.17 | 95 | 81 | 69 | 1.10 | 1.23 | 1.23 | 2.43 | 2.92 | 2.92 |
| compound 4 of the present invention | 0.17 | 0.22 | 0.27 | 112 | 107 | 145 | 1.19 | 1.54 | 1.58 | 2.56 | 3.31 | 3.48 |
| compound B | 0.15 | 0.19 | 0.19 | 100 | 87 | 75 | 1.20 | 1.25 | 1.29 | 2.62 | 3.04 | 3.05 |
| compound 5 of the present invention | 0.24 | 0.23 | 0.28 | 166 | 126 | 145 | 1.09 | 1.59 | 1.65 | 2.78 | 3.42 | 3.49 |
| compound C | 0.15 | 0.19 | 0.17 | 102 | 77 | 57 | 1.14 | 1.17 | 1.25 | 2.51 | 2.89 | 2.96 |
| compound 6 of the present invention | 0.17 | 0.21 | 0.23 | 148 | 117 | 120 | 1.03 | 1.27 | 1.35 | 2.48 | 3.08 | 3.24 |
| compound D | 0.16 | 0.21 | 0.21 | 102 | 81 | 63 | 1.10 | 1.16 | 1.36 | 2.50 | 2.89 | 2.97 |
| compound 7 of the present invention | 0.21 | 0.25 | 0.31 | 195 | 135 | 138 | 1.01 | 1.09 | 1.20 | 2.50 | 2.83 | 3.03 |
| compound E | 0.19 | 0.21 | 0.19 | 110 | 93 | 81 | 1.10 | 1.14 | 1.15 | 2.53 | 2.91 | 2.97 |
| compound 8 of the present invention | 0.17 | 0.23 | 0.29 | 182 | 129 | 132 | 0.92 | 0.98 | 1.09 | 2.61 | 3.03 | 3.24 |
| compound F | 0.13 | 0.14 | 0.17 | 98 | 54 | 61 | 1.10 | 1.04 | 1.14 | 2.43 | 2.63 | 2.83 |
| compound 9 of the present invention | 0.16 | 0.22 | 0.27 | 151 | 102 | 100 | 0.88 | 0.89 | 0.87 | 2.50 | 2.79 | 2.93 |
| compound 12 of the present invention | 0.15 | 0.18 | 0.16 | 112 | 67 | 87 | 1.28 | 1.40 | 1.20 | 2.40 | 2.65 | 2.96 |
| IB Gevachrome T710 | | | | | | | | | | | | |
| compound described in example 1 of U.S. Pat. No. 3,038,805 | 0.16 | 0.17 | 0.12 | 100 | 100 | 100 | 1.74 | 1.76 | 1.90 | 2.89 | 3.26 | 3.44 |
| compound 3 of the present invention | 0.20 | 0.21 | 0.17 | 115 | 83 | 138 | 1.83 | 1.90 | 2.08 | 2.95 | 3.50 | 3.50 |
| compound A | 0.15 | 0.16 | 0.11 | 75 | 79 | 74 | 1.67 | 1.70 | 1.69 | 2.60 | 3.04 | 3.01 |

-continued

| | fog | | | speed | | | gamma | | | $D_{max}$ | | |
|---|---|---|---|---|---|---|---|---|---|---|---|---|
| | blue | green | red | blue | green | red | blue | green | red | blue | green | red |
| compound 4 of the present invention | 0.17 | 0.19 | 0.14 | 77 | 102 | 117 | 1.94 | 1.94 | 1.98 | 2.82 | 3.47 | 3.50 |
| compound B | 0.16 | 0.17 | 0.12 | 74 | 77 | 69 | 1.75 | 1.76 | 1.78 | 2.78 | 3.12 | 3.06 |
| compound 5 of the present invention | 0.21 | 0.22 | 0.18 | 117 | 110 | 123 | 1.74 | 1.90 | 2.04 | 3.01 | 3.51 | 3.50 |
| compound C | 0.17 | 0.18 | 0.11 | 93 | 93 | 87 | 1.56 | 1.65 | 1.60 | 2.71 | 3.07 | 3.01 |
| compound 6 of the present invention | 0.18 | 0.21 | 0.14 | 102 | 100 | 98 | 1.69 | 1.80 | 1.83 | 2.71 | 3.22 | 3.28 |
| compound D | 0.17 | 0.18 | 0.13 | 85 | 85 | 81 | 1.55 | 1.65 | 1.66 | 2.61 | 3.04 | 2.99 |
| compound 7 of the present invention | 0.18 | 0.21 | 0.17 | 132 | 107 | 123 | 1.48 | 1.55 | 1.70 | 2.76 | 3.04 | 3.19 |
| compound E | 0.17 | 0.18 | 0.13 | 79 | 81 | 77 | 1.65 | 1.68 | 1.66 | 2.61 | 2.91 | 3.03 |
| compound 8 of the present invention | 0.19 | 0.22 | 0.20 | 112 | 100 | 126 | 1.54 | 1.69 | 1.60 | 2.83 | 3.14 | 3.28 |
| compound F | 0.16 | 0.17 | 0.11 | 87 | 83 | 85 | 1.70 | 1.60 | 1.50 | 2.68 | 3.02 | 2.99 |
| compound 9 of the present invention | 0.17 | 0.22 | 0.17 | 98 | 89 | 89 | 1.68 | 1.79 | 1.82 | 2.76 | 3.04 | 3.02 |
| compound 12 of the present invention | 0.18 | 0.19 | 0.12 | 105 | 79 | 98 | 1.60 | 1.69 | 1.69 | 2.62 | 3.05 | 3.18 |

Compounds A to F are of the type described in U.S. Pat. No. 4,038,075, already mentioned hereinbefore, corresponding to the formula $HOCH_2CH_2S(CH_2CH_2O)_nCH_2CH_2SCH_2OH$ wherein n is 3, 5, 8, 12, 21, and 33 respectively.

The above results show that when colour development takes place in the presence of a development activator used according to the invention, higher speed, higher contrast, and higher maximum density can be obtained than with the corresponding known dithioethers. The selectivity of colour reproduction is also favourable.

EXAMPLE 2

Single layer coatings of a coarse-grained gelatino silver bromoiodide emulsion layer having an average grain size of 0.8 μm and an iodide content of 7.2% by weight were made on a film support. The emulsion had been sensitized with the common panchromatic sensitizers, was stabilized with 5-methyl-7-hydroxy-s-triazolo[1,5-a]pyrimidine and contained a combination of a non-coloured cyan-forming coupler viz. N-[4'-(2''-cyclopentyl-4''-tert.butyl-phenoxy)-butyl]-1-hydroxy-2-naphthamide and a coloured cyan-forming coupler viz. the sodium salt of N-(2'-N-methyl-n-octadecylamino-5'-sulpho)-1-hydroxy-4-{2''-methoxycarbonyl-4''[1'''-(4''''-hydroxyphenyl)-isopropyl]-phenylazo}-2-naphthanilide.

Three coatings of this emulsion were made, two of them having different concentrations of the development activator no. 6 of the present invention, as specified in the table hereinafter.

The samples were exposed in an intensity scale sensitometer and processed according to the Eastman Color Negative film process (ECN-2). The colour development took 2 minutes.

The sensitometric results obtained with these samples, the first sample containing no development activator, were as follows.

| concentration of compound 6 per 100 g of $AgNO_3$ | fog | speed | gamma | $D_{max}$ |
|---|---|---|---|---|
| none | 0.09 | 100 | 0.50 | 1.05 |
| 45 mg | 0.13 | 200 | 0.70 | 1.30 |
| 114 mg | 0.15 | 186 | 0.71 | 1.33 |

The values for the speed are relative values corresponding to density 0.2 above fog. The speed obtained with the red-sensitized emulsion layer containing no development activator is given the value 100 (control). The other speed values are percent values in respect of the control.

The above results show that a concentration of 45 mg of compound 6 per 100 g of silver nitrate causes a manifest increase in speed, contrast, and maximum density. The fog increases but slightly.

EXAMPLE 3

Four strips A, B, C, and D of the multicolour reversal film material Gevachrome Type 710 described in Example 1 hereinafter were processed as described in Example 1 except for the fact that the strips after the black-and-white development and treatment in a stop-bath were rinsed and colour-developed as follows:

| Strip | Rinsing in water for 45 s at 23° C. | Colour development (4 min 15 s at 25° C. in colour developer of example 1 containing as development activator per liter: |
|---|---|---|
| A | with overall re-exposure | 250 mg of the reference compound according to U.S. Pat. Specification 4,013,471, already mentioned hereinbefore, and corresponding to the formula $HO-(CH(CH_2-S-CH_2-CH_2OH)-CH_2O)_nH$ n = approx. 21 and |
| B | without re-exposure | 2 g of compound 4 of the present invention |
| C | with overall re-exposure | idem as A |
| D | without re-exposure | 2 g of compound 6 of the present invention |

As appears from the above table, the silver halide remaining after black-and-white development of the strips A and C, which are comparison materials, was fogged by overall re-exposure and then colour developed in the presence of a known development activator, whereas the silver halide remaining after black-and-white development of the strips B and D was not overall re-exposed but colour-developed in the presence of fogging amounts of compounds 2 and 6 respectively of the present invention.

In the following table the sensitometric results obtained with strips A and C were compared with those obtained with the strips B and D respectively. The values of fog, speed, gamma, and maximum density are given.

The values given for speed are relative values corresponding to density 1.0. The higher the value given, the higher the speed.

The values given for gamma are the values of gradation measured from the characteristic curve over an exposure range of log It=0.60 starting from density 0.7 above fog.

| Strip of Gevachrome T710 | Fog | | | Speed | | | Gamma | | | $D_{max}$ | | |
|---|---|---|---|---|---|---|---|---|---|---|---|---|
| | blue | green | red | blue | green | red | blue | green | red | blue | green | red |
| A | 0.18 | 0.17 | 0.14 | 100 | 100 | 100 | 1.70 | 1.55 | 1.40 | 2.73 | 2.74 | 2.87 |
| B | 0.20 | 0.18 | 0.15 | 75 | 107 | 100 | 1.76 | 2.05 | 2.16 | 2.50 | 2.76 | 3.10 |
| C | 0.13 | 0.13 | 0.10 | 100 | 100 | 100 | 2.00 | 1.78 | 1.55 | 2.87 | 2.94 | 2.82 |
| D | 0.12 | 0.12 | 0.12 | 78 | 138 | 135 | 1.73 | 2.09 | 1.90 | 2.28 | 2.76 | 2.80 |

The above results show that the compounds of the invention can be used advantageously also in reversal processing as fogging agents for the silver halide remaining after the first development instead of fogging the latter by overall re-exposure.

We claim:

1. Method of developing an image-wise exposed photographic silver halide element in the presence of an oxathioether development activator, wherein the oxathioether development activator corresponds to the following general formula:

$$R^1—A—(OCH_2CH_2)_n—S—A'—(X—A'')_m—Y—R^2$$

wherein:

$R^1$ represents hydrogen, a $C_1$-$C_4$ alkyl group, a $C_1$-$C_4$ alkyl group substituted by one or more hydroxy groups, or the group $R^2$—Y—(A''—X)$_m$—A'—S—, A, A', and A'' (same or different) each represent a $C_1$-$C_5$ alkylene group, with the proviso that A is a chemical monovalent bond when $R^1$ is hydrogen or alkyl or substituted alkyl, X represents —OCO—, —$SO_2$—, —CONH—, or the group Y, Y represents a ligand or complexing function of the type of —S— and —N(Q)—, Q being hydrogen or alkyl, $R^2$ represents a $C_1$-$C_4$ alkyl group or a $C_1$-$C_4$ alkyl group substituted by one or more hydroxy groups, or when Y is —N(Q)—, $R^2$ may represent together with Q the atoms necessary to complete a nitrogen-containing saturated ring, n is a positive whole number of at least 2, and m is 0 or 1.

2. Method according to claim 1, wherein said oxathioether development activator is present in the developing solution.

3. Method according to claim 2, wherein said oxathioether development activator is present in said developing solution in an amount of 50 mg to 10 g per liter.

4. Method according to claim 2, wherein said developing solution is used as the second developer of a reversal processing method.

5. Method according to claim 1, wherein the photographic element is a colour element and the development is a colour development.

6. Method according to claim 5, wherein said photographic colour element incorporates colour couplers.

7. Method according to claim 5, wherein said photographic colour element is a multicolour element comprising a blue-sensitive emulsion layer with yellow-forming colour coupler, a green-sensitized emulsion layer with magenta-forming colour coupler, and a red-sensitized emulsion layer with a cyan-forming colour coupler.

8. A photographic developer comprising a silver halide developing agent and an oxathioether development activator wherein said oxathioether corresponds to the following general formula:

$$R^1—A—(OCH_2CH_2)_n—S—A'—(X—A'')_m—Y—R^2$$

wherein:

$R^1$ represents hydrogen, a $C_1$-$C_4$ alkyl group, a $C_1$-$C_4$ alkyl group substituted by one or more hydroxy groups, or the group $R^2$—Y—(A''—X)$_m$—A'—S—, A, A', and A'' (same or different) each represent a $C_1$-$C_5$ alkylene group, with the proviso that A is a chemical monovalent bond when $R^1$ is hydrogen or alkyl or substituted alkyl, X represents —OCO—, —$SO_2$—, —CONH—, or the group Y, Y represents a ligand or complexing function of the type of —S— and —N(Q)—, Q being hydrogen or alkyl, $R^2$ represents a $C_1$-$C_4$ alkyl group or a $C_1$-$C_4$ alkyl group substituted by one or more hydroxy groups, or when Y is —N(Q)—, $R^2$ may represent together with Q the atoms necessary to complete a nitrogen-containing saturated ring, n is a positive whole number of at least 2, and m is 0 or 1.

9. A photographic developer according to claim 8, wherein the oxathioether development activator is present in an amount comprised between about 50 mg and 10 g per liter.

10. A photographic developer according to claim 8, wherein the developing agent is an aromatic primary amino colour developing agent.

11. A photographic developer according to claim 10, wherein said developing agent is a p-phenylene diamine colour developing agent.

12. A photographic element containing a silver halide emulsion layer and an oxathioether development activator, wherein said oxathioether corresponds to the following general formula:

$$R^1—A—(OCH_2CH_2)_n—S—A'—(X—A'')_m—Y—R^2$$

wherein:

$R^1$ represents hydrogen, a $C_1$–$C_4$ alkyl group, a $C_1$–$C_4$ alkyl group substituted by one or more hydroxy groups, or the group $R^2$—Y—(A″—X)$_m$—A′—S—, A, A′, and A″ (same or different) each represent a $C_1$–$C_5$ alkylene group, with the proviso that A is a chemical monovalent bond when $R^1$ is hydrogen or alkyl or substituted alkyl, X represents —OCO—, —$SO_2$—, —CONH—, or the group Y, Y represents a ligand or complexing function of the type of —S— and —N(Q)—, Q being hydrogen or alkyl, $R^2$ represents a $C_1$–$C_4$ alkyl group or a $C_1$–$C_4$ alkyl group substituted by one or more hydroxy groups, or when Y is —N(Q)—, $R^2$ may represent together with Q the atoms necessary to complete a nitrogen-containing saturated ring, n is a positive whole number of at least 2, and m is 0 or 1.

* * * * *